US009139210B2

(12) United States Patent
Ning et al.

(10) Patent No.: US 9,139,210 B2
(45) Date of Patent: Sep. 22, 2015

(54) METHOD OF MOVEMENT AUTHORITY CALCULATION FOR COMMUNICATIONS-BASED TRAIN CONTROL SYSTEM

(75) Inventors: Bin Ning, Beijing (CN); Haifeng Wang, Beijing (CN); Tao Tang, Beijing (CN); Chunhai Gao, Beijing (CN); Xuwen Yang, Beijing (CN); Shuo Liu, Beijing (CN)

(73) Assignee: BEIJING JIAOTONG UNIVERSITY, Beijing (CN)

( * ) Notice: Subject to any disclaimer, the term of this patent is extended or adjusted under 35 U.S.C. 154(b) by 172 days.

(21) Appl. No.: 13/818,953

(22) PCT Filed: Aug. 23, 2011

(86) PCT No.: PCT/CN2011/001407

§ 371 (c)(1),
(2), (4) Date: May 3, 2013

(87) PCT Pub. No.: WO2012/024895

PCT Pub. Date: Mar. 1, 2012

(65) Prior Publication Data

US 2013/0218375 A1 Aug. 22, 2013

(30) Foreign Application Priority Data

Aug. 24, 2010 (CN) ..... 2010 1 0261757

(51) Int. Cl.
*B61L 27/00* (2006.01)
*B61L 23/14* (2006.01)

(52) U.S. Cl.
CPC ..... *B61L 27/00* (2013.01); *B61L 23/14* (2013.01); *B61L 27/0038* (2013.01); *B61L 2027/005* (2013.01)

(58) Field of Classification Search
CPC ... B61L 15/0027; B61L 3/006; B61L 25/026; B61L 23/00; B61L 25/021; B61L 27/0088; B61L 15/009; B61L 25/00; B61L 27/0027; B61L 3/008; B61L 3/221; B61L 17/00; B61C 17/12; B61C 7/04; G06F 17/00
See application file for complete search history.

(56) References Cited

U.S. PATENT DOCUMENTS 5,437,422 A * 8/1995 Newman ..... 246/5
5,533,695 A * 7/1996 Heggestad et al. ..... 246/62

(Continued)

FOREIGN PATENT DOCUMENTS

EP 2216230 A1 * 8/2010

*Primary Examiner* — James Trammell
*Assistant Examiner* — Demetra Smith-Stewart
(74) *Attorney, Agent, or Firm* — Knobbe Martens Olson & Bear LLP

(57) ABSTRACT

The present invention discloses a calculation method of movement authority for communications-based train control system, comprising: handling a route information for a train, and determining a searching range of the train according to the route information; initializing the limit of movement authority with the end position of the searching range; searching for static obstacles within the searching range, and successively determining whether each static obstacle meets the safety requirements for train operating, if not, setting the position of the last static obstacle within the searching range as the limit of the movement authority; if so, modifying the limit of movement authority as the end of route having been matched; searching for dynamic obstacles within the searching range, and determining whether there is a train, if so, modifying the end of movement authority as the beginning point of the track section where the train is occupying; if there is no dynamic obstacle within the searching range, modifying the final end of movement authority as the position of the last static obstacle within the searching range. In accordance with the present invention, it is possible to increase line capacity and improve traffic fluidity for rail transit.

7 Claims, 5 Drawing Sheets

(56) References Cited

U.S. PATENT DOCUMENTS 5,828,979 A * 10/1998 Polivka et al. ..... 701/117
6,135,396 A * 10/2000 Whitfield et al. ..... 246/182 R
8,295,999 B2 * 10/2012 Groves et al. ..... 701/19
8,565,945 B2 * 10/2013 Allshouse et al. ..... 701/19
2010/0299007 A1 * 11/2010 Ghaly ..... 701/20
2012/0018591 A1 * 1/2012 Ghaly ..... 246/192 R
2014/0129061 A1 * 5/2014 Cooper et al. ..... 701/19

* cited by examiner

METHOD OF MOVEMENT AUTHORITY CALCULATION FOR COMMUNICATIONS-BASED TRAIN CONTROL SYSTEM

CROSS-REFERENCE TO RELATED APPLICATIONS

This application is the U.S. National Phase under 35. U.S.C. §371 of International Application PCT/CN2011/001407, filed Aug. 23, 2011, which claims priority to Chinese Patent Application No. 201010261757.8, filed Aug. 24, 2010. The International Application was published under PCT Article 21(2) in a language other than English.

FIELD OF THE INVENTION

The present invention relates to the technical field of railway train control, in particular to a calculation method of movement authority for communications-based train control systems.

BACKGROUND OF THE INVENTION

The communications-based train control system (CBTC) has become the trend for development of train control system in rail transit. CBTC introduces communication subsystem into the system and establishes continuous, two-way and high speed onboard-wayside communication. In this way, the command and state of a train can be reliably exchanged between the train and the wayside equipment, and hence the major CBTC wayside equipment and the controlled object (train) can be reliably and effectively connected. A safe interval between trains can be ensured based on precise train-positioning.

Specifically, the term "movement authority (MA)" refers to a part of line from the rear of a train to a front obstacle served as the terminal point, and the term "end of movement authority" refers to the target point which the train cannot overtakes under any circumstance. A schematic diagram of the movement authority according to the prior art is shown in FIG. 1. In a CBTC system, a zone controller subsystem determines the running direction and movement authority of a train according to the route information, track data and temporary speed restriction information, etc. provided by interlocking subsystems. The zone controller subsystem also ensures a safe interval between the leading train and the following train so as to meet the requirements for designed operation interval and turn-back interval. It continuously sends necessary information of speed, distance and track state, etc. to onboard equipments, or transmits information of operation authority of a train to onboard equipments, so as to enable the onboard equipments to determine the safety speed restriction for train operation. This ensures a safe interval between trains and prevents from over-speed.

In the present urban rail transit, certain defects still exist when realizing train tracking, although wireless communication has been used to carry out onboard-wayside information exchange.

In the control system of urban rail transit abroad, the equipments used for measuring the secondary track occupation can be classified as the multi-information track circuit, the digital track circuit and the axle counter.

In the control system using multi-information track circuit and digital track circuit, the speed of a train follows a speed level. FIG. 2 shows a schematic view of train tracking following the speed level according to the prior art; wherein the curved line represents the movement authority of a train, with the tracking interval determined by the resolution of the track circuit section. Such resolution is a block section, and the lower the resolution is, the shorter the interval for train operation will be. However, the length of track circuit sections is relatively longer in practical, generally more than 600 meters, which has considerably influenced the operation efficiency.

In a system that combines the wireless communication with track sections/track circuits, as comparison, the physical sections, i.e. the track sections/track circuits, are logically subdivided into a plurality of virtual sections, so that the train tracking can be realized on the basis of train-positioning with a virtual section as a unit. The speed of the train follows a segmental curve with a relatively higher resolution. FIG. 3 shows a schematic view of train tracking following the segmental curve according to the prior art, wherein the curved line represents the movement authority of a train; the virtual sections are subsets of the block sections.

Comparing with the block sections, the length of the virtual sections is shorter, generally about 50 meters, and the tracking interval between trains is smaller.

Comparing with the speed level, the segmental curve improves the efficiency to a certain degree. However, as the control system of urban rail transit requires for high density and large passenger flow, such system aboard has not fully made use of the advantages of communications-based train control system yet, and involves the following problems:

(1) The train in operation can only be positioned by means of track circuits or virtual sections at a poor accuracy, and a precise train-positioning has not been achieved yet;

(2) The tracking interval between trains is relatively longer, as a result, the movement authority is unable to increase the operation efficiency to a greatest extent;

(3) The expandability is poor, which is attributed to the tracking methods following speed level or segmental curve. In this case, if operation efficiency is required to be increased, a large number of wayside equipments have to be incorporated into the system, which results in exorbitant cost for upgrade.

SUMMARY OF THE INVENTION

The technical problem to be solved by the present invention is how to improve the precision of tracking interval between trains, and how to increase the operation efficiency of the train by means of the movement authority.

For this purpose, the present invention provides a method of movement authority calculation for communications-based train control system, comprising:

step A1, handling a route information for a train, and determining a searching range of the train according to the route information;

step A2, initializing the end of movement authority with the position of the terminal point of searching range;

step A3, searching for static obstacles within the searching range, and determining whether each of the static obstacles meets the demand for safe train operation, successively, if not, setting the position of the last static obstacle within the searching range as the end of movement authority; if so, modifying the end of movement authority as the end of the route having been matched;

step A4, searching for dynamic obstacles within the searching range, and determining whether there is any following train, if so, modifying the end of movement authority as the start point of the track section where the train locates;

if there is no dynamic obstacle within the searching range, modifying the final end of movement authority as the position of the last static obstacle within the searching range.

Wherein, in particular, the step A1 further comprises:

step A11, a zone controller handles the route information;

step A12, positioning a train in a route, and determining a searching range;

step A13, deleting the information of unlocked track sections and information of obstacles from the route information.

The route information includes the information of route range of a train, information of obstacles in the route and information of signal for protecting the route. The information of obstacles includes the switch information, shielding door information, section-locking information and emergency stop button information.

In particular, the step A3 further comprises:

step A31, searching for static obstacles within the searching range;

step A32, determining whether the state of the static obstacle corresponds to that required by an interlocking table; if so, performing step A33; otherwise, then performing step A33';

step A33, determining whether the static obstacle is the last one in the searching range; if so, performing step A34; otherwise, then performing step A31;

step A34, setting the end of movement authority of the last static obstacle as the end of the route having been matched;

step A33', setting the end of movement authority of the obstacle being searched as the position of such obstacle; performing step A4.

The state of the static obstacle includes the position of switch, opening/closing state of shielding door, and pressing-down/un-pressing-down state of emergency stop button. The state required by the interlocking table includes: the position of switch is normal or reverse; the shielding door is closed, and the emergency stop button has not been pressed-down.

In particular, the step A4 further comprises:

step A41, searching for leading trains according to a sequence of train operation;

step A42, determining whether there is a leading train within the searching range, if so, performing step A43, otherwise, then performing step A43';

step A43, determining whether the leading train is a communication train; if so, performing step A44; otherwise, then performing step A44';

step A44, determining whether the leading train served as a communication train carries an undetermined flag at its rear; if so, performing step A45', otherwise, then performing step A45;

step A45, determining the movement authority according to a position reported by the leading train;

step A43', setting the position of the last obstacle in the searching range as the final end of movement authority;

step A44', withdrawing the movement authority set in step A34 according to a train control separation principle;

step A45', setting the start point of track section where the train locates as the end of movement authority.

The separation principle for train control defines that a movement authority of a following train is not permitted to overtake a leading train, and an interval between a following train with CBTC and a leading train without CBTC is required.

After the step A4, it further comprises:

step A46, generating a movement authority for a zone controller in the present section;

step A47, determining whether a mixed movement authority is needed; if so, performing step A48, otherwise, then performing step A49;

step A48, mixing the movement authorities;

step A49, generating a final movement authority.

The above-mentioned technical solution is advantageous in that it realizes precise train-positioning by dynamically continuously generating movement authority according to the state of the obstacles in front of a running train, ensures the train to operate under continuous control, and reduces the interval between trains so as to realize transit management such as dynamic meeting, overtaking and blocking. Furthermore, it dramatically improves the track capacity and average operation speed of train, and enhances the reliability of train operation and utilization of infrastructure.

DETAILED DESCRIPTION OF THE INVENTION

Figure 1:
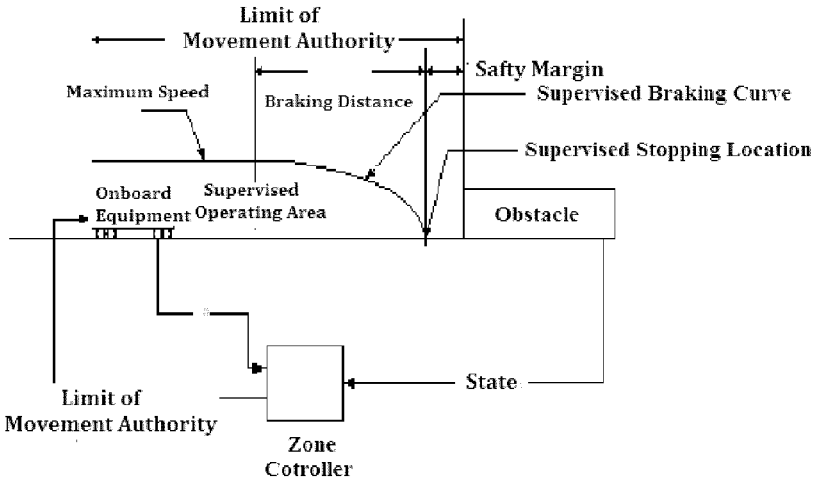
FIG. 1 is a schematic view of the movement authority according to the prior art.
Figure 2:
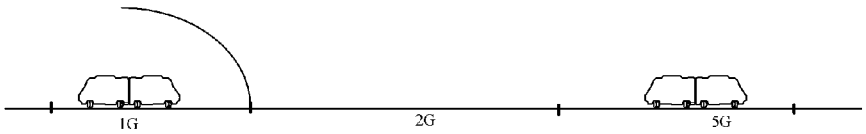
FIG. 2 is a schematic view of train tracking following a speed level according to the prior art.
Figure 3:
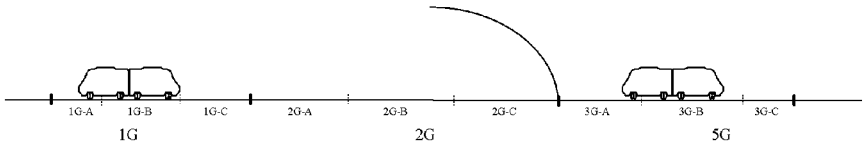
FIG. 3 is a schematic view of train tracking following a segmental curve according to the prior art.
Figure 4:
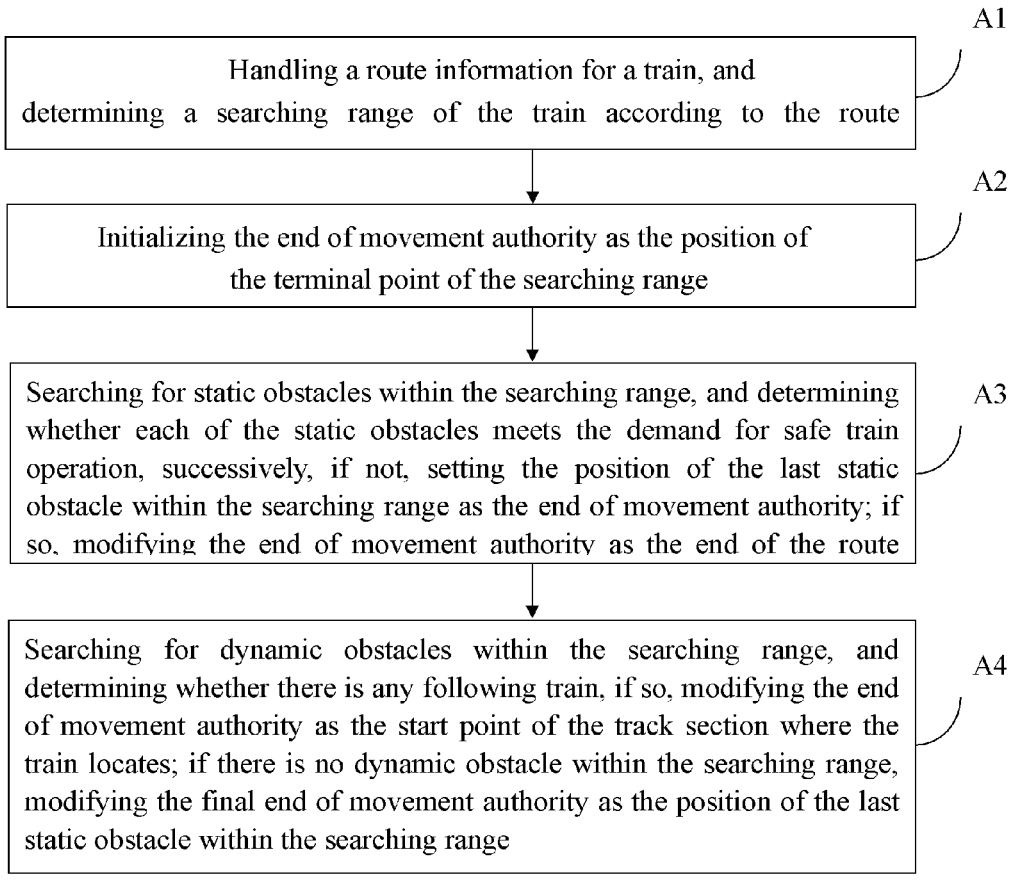
FIG. 4 is a flow chart of a method of movement authority calculation for communications-based train control system in accordance with an embodiment of the present invention.
Figure 5:
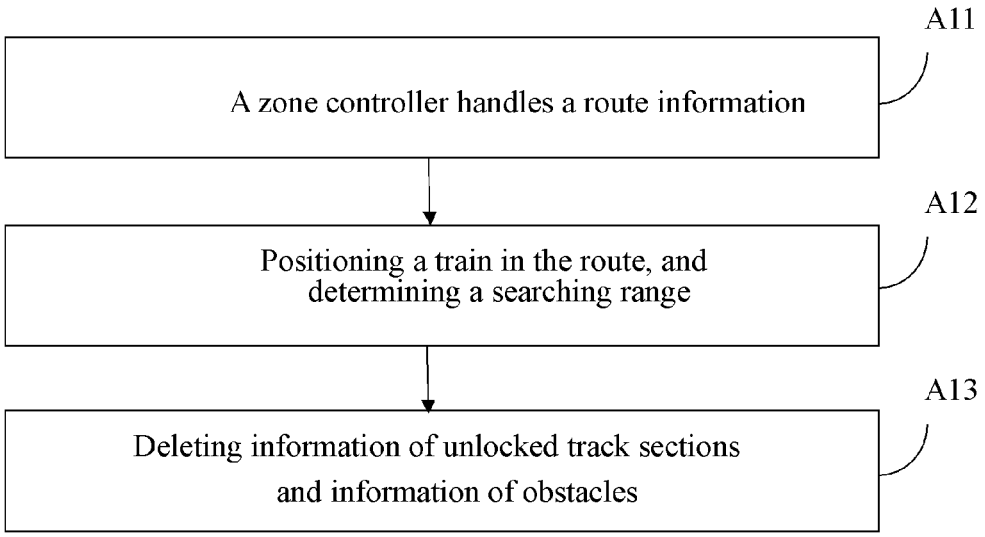
FIG. 5 is a flow chart of a method for determining the searching range in accordance with an embodiment of the present invention.
Figure 6:
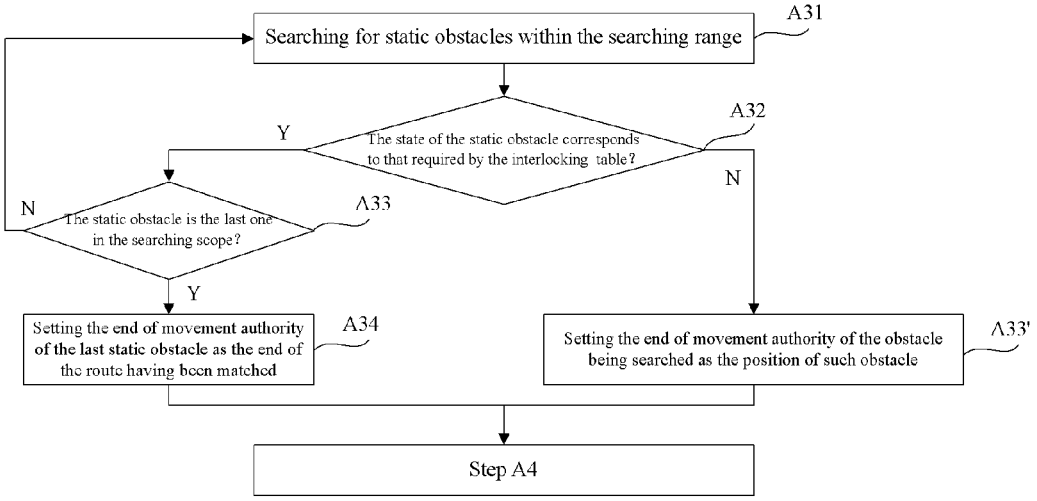
FIG. 6 is a flow chart of a method for searching for static obstacles in accordance with an embodiment of the present invention.

Hereinafter, the embodiments of the present invention will be described in further details in combination with figures and examples. The embodiments below are used for illustrating the present invention only, but not for limiting the scope thereof As shown in FIG. 4, it is a flow chart of a method of movement authority calculation for communications-based train control system in accordance with an embodiment of the present invention. The present embodiment comprises steps as follows:

Step A1: handling a route information for a train, and determining the searching range of the train according to the route information;

As shown in FIG. 5, it is a flow chart of a method for determining the searching range in accordance with an embodiment of the present invention; the step A1 further comprises:

Step A11, a zone controller handles the route information of the train;

The zone controller generates a movement authority for the train. Besides taking the location information of the train into consideration, it is also necessary to incorporate related information from the interlocking subsystem. The interlocking subsystem sets up the corresponding route according to the command for calling a route sent from the automatic train supervision system (ATS) in combination with the state of the interlocking subsystem. The route information of the present embodiment includes: the route range information of the train, i.e. the track sections; information of obstacles in the route, including the switch information, shielding door information, section-locking information and emergency stop button information, etc.; and also the information of signal for protecting the route, etc.;

Step A12, positioning the train in the route, and determining the searching range;

In particular, a zone controller determines the searching range according to the route information, obstacle information, and information of track sections located within the route; and obtains a sequence of train operation;

Step A13, deleting the information of unlocked track section and information of obstacles from the route information;

In particular, according to the unlocking state of route, if the track section where the obstacle locates has been unlocked, deleting the corresponding information of obstacles and information of track section where the obstacle locates, from the route information;

Step A2, setting the end of movement authority as the terminal point of the searching range;

In this step, initializing the position of the end of movement authority, and setting the position of terminal point of the searching range as the end of movement authority;

Step A3, searching for static obstacles within the searching range, and determining whether each of the static obstacles meets the demand for safe train operation successively; if not, setting the position of the last static obstacle within the searching range as the end of movement authority; if so, modifying the end of movement authority as the end of the route having been matched;

As shown in FIG. 6, it is a flow chart of a method for searching for static obstacles in accordance with an embodiment of the present invention; the step A3 further comprises:

Step A31, searching for static obstacles within the searching range;

inspecting the quantity and category of the static obstacles within the searching range;

Step A32, determining whether the state of the static obstacle corresponds to the state required by the interlocking table; if so, performing step A33, otherwise, then performing step A33';

If the state of the static obstacle corresponds to the state required by the interlocking table, the static obstacle meets the requirements for safe train operation; otherwise, the static obstacle does not meet the requirements for safe train operation. If there exists more than one static obstacle, the determination step is then performed in a sequence beginning with the static obstacle closest to the present train;

The state of the static obstacles includes the position of switch, opening/closing state of shielding door, and pressing-down/un-pressing-down state of emergency stop button, etc.;

The state required by the interlocking table includes: the position of switch is normal or reverse; the shielding door is closed; and the emergency stop button has not been pressed-down.

Figure 7:
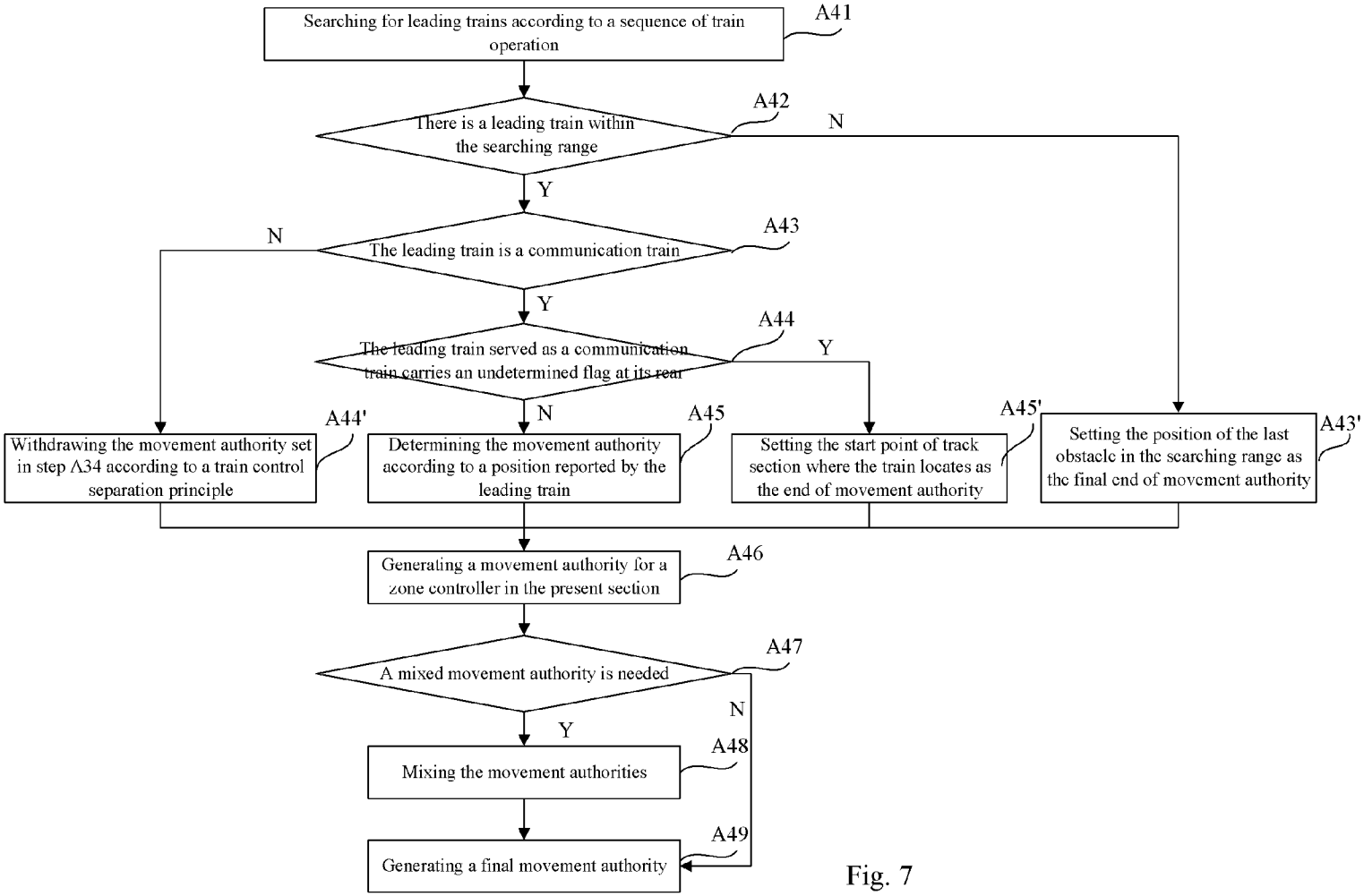
FIG. 7 is a flow chart of a method for searching for dynamic obstacles in accordance with an embodiment of the present invention.

Step A33, determining whether such static obstacle is the last one within the searching range; if so, performing step A34, otherwise, then performing step A31;

Step A34, setting the end of movement authority of the last static obstacle as the terminal point of the route having been matched;

Step A33', setting the end of movement authority of the obstacle being searched as the position of the obstacle which does not correspond to the state as required by the interlocking table; then performing step A4;

Step A4, searching for dynamic obstacles within the searching range, and determining whether there is any train tracking, if so, modifying the end of movement authority as the start point of the track section where the train locates; if there is no dynamic obstacle within the searching range, modifying the final end of movement authority as the position of the last static obstacle within the searching range; wherein the start point of the track section is the position by which the train initially passes when entering the track section;

As shown in FIG. 7, it is a flow chart of a method for searching for dynamic obstacles in accordance with an embodiment of the present invention; the step A4 further comprises:

Step A41, searching for leading trains according to the sequence of train operation;

Step A42, determining whether there is a leading train within the searching range, if so, performing step A43, otherwise, then performing step A43';

Step A43, determining whether the leading train is a communication train; if so, performing step A44, otherwise, then performing step A44';

In case that a plurality of leading trains are present, performing the determination step for these leading trains in a sequence beginning with the one closet to the current train;

If the leading train is a communication train, the movement authority of the following train is able to track the leading train, and varies with the operation of the leading train;

Step A44, determining whether the leading train served as a communication train carries an undetermined flag at the rear; if so, performing step A45', otherwise, then performing step A45;

When the leading train carries an undetermined flag at the rear, it means that such leading train is a train being tracked. In this case, the movement authority of the current train is able to track the leading train according to the undetermined flag at the rear of the leading train, and varies with the operation of the leading train;

Since the system cannot get the state of sections behind a train that has just been positioned, the sections within a preset range behind this train is considered as undetermined sections, and an undetermined flag will be disposed at the rear of the train; correspondingly, the following train can detect that the leading train carries an undetermined flag at the rear through communication. When the following train confirms the state of the sections behind the leading train through detection methods, it removes the undetermined section and the undetermined flag at the rear of the leading train;

Step A45, determining the movement authority according to the position reported by the leading train in a sequence of train operation;

setting the rear of the train that is served as a communication train but does not carry an undetermined flag at its rear as the end of movement authority;

Step A43', setting the position of the last obstacle in the searching range as the final end of movement authority; performing step A46;

Step A44', withdrawing the movement authority set in step A34 according to a separation principle for train control;

The separation principle for train control in this embodiment defines that the movement authority of a following train is not permitted to overtake a leading train, and an interval between a following train with CBTC and a leading train without CBTC is required.

Step A45', setting the start point of the track section where the train locates as the end of movement authority.

Step A46, generating the movement authority for the zone controller in the present section;

Step A47, determining whether a mixed movement authority is needed; if so, performing step A48, otherwise, then performing step A49;

When a zone controller in the present section receives a movement authority calculated for the present train by another zone controller in the next adjacent section, it is necessary to mix the two movement authorities; otherwise, it is not necessary to do so;

Step A48, mixing the movement authorities;

When the zone controllers are handing over, it is necessary to combine the two movement authorities respectively calculated by the two zone controllers to obtain a final movement authority for guiding train operation, because the train now is running within a section co-managed by two zone controllers;

Step A49, generating the final movement authority.

INDUSTRIAL APPLICABILITY

The method of movement authority calculation for communications-based train control system as proposed by the present invention realizes a precise train-positioning by dynamically and continuously generating movement authority according to the state of obstacles in front of a running train. In this way, it ensures the train to operate under continuous control, and reduces the interval between running trains so as to realize the transit management such as dynamic meeting, overtaking and blocking. Furthermore, it dramatically improves the track capacity and average running speed of the train, and enhances the reliability of train operation and the utilization of infrastructure.

What is claimed is:

1. A method of movement authority calculation for communications based train control system, characterized in that, it comprises:

step A1, handling a route information for a train by a zone controller, and determining a searching range of the train according to the route information;

step A2, initializing the end of movement authority with the position of the terminal point of the searching range;

step A3, searching for static obstacles within the searching range, and successively determining whether each of the static obstacles meets the demand for safe train operation; if not, setting the position of the last static obstacle within the searching range as the end of movement authority; if so, modifying the end of movement authority as the end of the route having been matched;

step A4, searching for dynamic obstacles within the searching range, and determining whether there is any train tracking;

if so, modifying the end of movement authority as the start point of the track section where the train locates;

if there is no dynamic obstacle within the searching range, modifying the final end of movement authority as the position of the last static obstacle within the searching range wherein the step A4 further comprises:

step A41, searching for leading trains according to a sequence of train operation;

step A42, determining whether there is a leading train within the searching range, if so, performing step A43, determining whether the leading train is a communication train, otherwise, then performing step A43', setting the position of the last obstacle within the searching range as the final end of movement authority;

step A43, determining whether the leading train is a communication train; if so, performing step A44, determining whether the leading train served as a communication train carries an undetermined flag at the rear, otherwise, then performing step A44', withdrawing the movement authority set in step A34, which sets the end of movement authority of the last static obstacle as the end of the route having been matched, according to a separation principle for train control; and step A44, determining by the zone controller whether the leading train served as a communication train carries an undetermined flag at the rear; if so, performing step A45', setting the start point of the track section where the train locates as the end of movement authority, otherwise, then performing step A45, determining by the controller the movement authority according to a position reported by the leading train and moving the train to the end of the movement authority determined by the zone controller.

2. The method of movement authority calculation for communications-based train control system of claim 1, characterized in that, the step A1 comprises:

step A11, a zone controller handles a route information;

step A12, positioning a train in the route, and determining a searching range;

step A13, deleting information of unlocked track sections and information of obstacles from the route information.

3. The method of movement authority calculation for communications-based train control system of claim 1, characterized in that, the route information comprises:

the information of route range of a train, information of obstacles in the route and information of signal for protecting the route; and the information of obstacles comprises:

switch information, shielding door information, section-locking information and emergency stop button information.

4. The method of movement authority calculation for communications-based train control system of claim 1, characterized in that, the step A3 comprises:

step A31, searching for static obstacles within the searching range;

step A32, determining whether the state of the static obstacle corresponds to that required by an interlocking table;

if so, performing step A33, otherwise, then performing step A33';

step A33, determining whether the static obstacle is a last one in the searching range; if so, performing step A34, otherwise, then performing step A31;

step A34, setting the end of movement authority of the last static obstacle as the end of the route having been matched; and step A33', setting the end of movement authority of the obstacle being searched as the position of such obstacle.

5. The method of movement authority calculation for communications-based train control system of claim 4, characterized in that, the state of static obstacle comprises:

the switch position, opening/closing state of shielding door, and pressing-down/un-pressing-down state of emergency stop button; and the state required by the interlocking table comprises: the position of switch is normal or reverse, the shielding door is closed, and the emergency stop button has not been pressed down.

6. The method of movement authority calculation for communications-based train control system of claim 1, characterized in that, the separation principle for train control is defined as: the movement authority of a following train is not permitted to overtake a leading train, and an interval between a following train with CBTC and a leading train without CBTC is required.

7. The method of movement authority calculation for communications-based train control system of claim 1, characterized in that, after the step A4, it further comprises:

step A46, generating a movement authority for a zone controller in the current section;

step A47, determining whether a mixed movement authority is needed; if so, performing step A48, otherwise, then performing step A49;

step A48, mixing the movement authorities; and step A49, generating a final movement authority.

* * * * *